US012466520B2

(12) United States Patent
Zhang et al.

(10) Patent No.: US 12,466,520 B2
(45) Date of Patent: Nov. 11, 2025

(54) MARINE EMERGENCY RESCUE TRANSFER SYSTEM

(71) Applicant: WUHAN UNIVERSITY OF TECHNOLOGY, Wuhan (CN)

(72) Inventors: Fan Zhang, Wuhan (CN); Chunhui Zhou, Wuhan (CN); Jiahao Zhong, Wuhan (CN); Cheng Li, Wuhan (CN); Jing Li, Wuhan (CN); Yiran Ding, Wuhan (CN)

(73) Assignee: WUHAN UNIVERSITY OF TECHNOLOGY, Wuhan (CN)

( * ) Notice: Subject to any disclaimer, the term of this patent is extended or adjusted under 35 U.S.C. 154(b) by 770 days.

(21) Appl. No.: 17/880,673

(22) Filed: Aug. 4, 2022

(65) Prior Publication Data

US 2022/0371698 A1 Nov. 24, 2022

Related U.S. Application Data

(63) Continuation of application No. PCT/CN2021/113466, filed on Aug. 19, 2021.

(30) Foreign Application Priority Data

Oct. 10, 2020 (CN) ..... 202011079115.6

(51) Int. Cl.
*B63B 27/30* (2006.01)
*B63C 9/26* (2006.01)
*B63C 9/28* (2006.01)

(52) U.S. Cl.
CPC ..... *B63B 27/30* (2013.01); *B63C 9/26* (2013.01); *B63C 9/28* (2013.01)

(58) Field of Classification Search
CPC .. B63B 27/30; B63C 9/26; B63C 9/28; B63C 11/52; B63C 7/006
See application file for complete search history.

(56) References Cited

U.S. PATENT DOCUMENTS 5,052,319 A 10/1991 Beyrouty
5,947,051 A * 9/1999 Geiger ..... E21B 41/04 114/313

(Continued)

FOREIGN PATENT DOCUMENTS

CN 203631854 U 7/2014
CN 106882348 A 6/2017

(Continued)

OTHER PUBLICATIONS

International Search Report issued in corresponding International application No. PCT/CN2021/113466, mailed Nov. 25, 2021.

(Continued)

*Primary Examiner* — Eldon T Brockman

(57) ABSTRACT

A marine emergency rescue transfer system includes a water navigation robot. An attracting device configured to attach and fix with an accident ship is installed on one side of the water navigation robot. An automatic lifting device is installed on the water navigation robot. A fixing sealing device is installed on the automatic lifting device. The automatic lifting device is installed on the automatic lifting device. The fixing sealing device includes a box body and a vacuum pump. The box body defines a cavity. The vacuum pump is configured to pump air or water in the cavity, so the box body is fixed on the accident ship through atmospheric pressure or water pressure. The rescue devices are placed in the fixing sealing device. The remote control grippers are installed on the automatic lifting device. The remote control grippers are configured to grip the rescue devices for transfer operation.

10 Claims, 9 Drawing Sheets

(56) References Cited

U.S. PATENT DOCUMENTS

| | | | | |
|---|---|---|---|---|
| 6,269,763 | B1 * | 8/2001 | Woodland | B63B 35/66 43/4.5 |
| 2019/0308703 | A1 * | 10/2019 | Ranieri | B63C 9/22 |

FOREIGN PATENT DOCUMENTS

| | | | |
|---|---|---|---|
| CN | 107406127 | A | 11/2017 |
| CN | 107600333 | A | 1/2018 |
| CN | 108001683 | A | 5/2018 |
| CN | 110184253 | A | 9/2019 |
| CN | 111086606 | A | 5/2020 |
| CN | 112339915 | A | 2/2021 |
| DE | 4401909 | A1 | 7/1995 |
| EP | 0655040 | A1 | 5/1995 |
| KR | 20080015914 | A | 2/2008 |
| KR | 20090081844 | A | 7/2008 |
| WO | 9500388 | A1 | 1/1995 |

OTHER PUBLICATIONS

Written Opinion of the International Searching Authority for No. PCT/CN2021/113466.

Zongye Miao: "«FSOU Emergency Transfer Operation Conditions and Berthing Plan»", pp. 26-28.

Zhenri Chen: "«Offshore Transfer Operation and Emergency Countermeasures of Ultra-Large Oil Tankers in Zhanjiang Port»", pp. 245-249.

* cited by examiner

MARINE EMERGENCY RESCUE TRANSFER SYSTEM

TECHNICAL FIELD

The present disclosure relates to a technical field of ship transfer control, in particular to a marine emergency rescue transfer system.

BACKGROUND

Ship transfer is transfer of cargo from one ship to another. Ship transportation of hazardous chemicals is developing day by day, but once an accident occurs, consequences are very serious. Emergency rescue of an accident ship loading the hazardous chemicals has received more and more attention in the field. At sea, there are many difficulties in the emergency rescue of an accident ship loading liquid hazardous chemicals; especially when the accident occurred far away from the shore and the accident ship is on fire and the fire could not be controlled. It is urgent to adopt effective emergency rescue means.

At present, there are relatively few studies on emergency rescue transfer of accident ships loading the liquid hazardous chemicals, and there is no clear device and method for emergency rescue of the accident ships loading the liquid hazardous chemicals. Therefore, it is of great significance for the rescue of accident ships loading the hazardous chemicals to provide a marine emergency rescue transfer device and a method thereof for the accident ships loading the hazardous chemicals.

SUMMARY

In view of this, it is necessary to provide a marine emergency rescue transfer system to solve a problem of lack of an effective emergency transfer device for rescue of an accident ship loading liquid hazardous chemicals.

The present disclosure provides a marine emergency rescue transfer system. The marine emergency rescue transfer system comprises a water navigation robot, an automatic lifting device, a fixing sealing device, remote control grippers, rescue devices, a rescue terminal, and a remote control terminal.

An attracting device configured to attach and fix with an accident ship is installed on one side of the water navigation robot. The automatic lifting device is installed on the water navigation robot. The fixing sealing device is installed on the automatic lifting device. The automatic lifting device is installed on the automatic lifting device. The fixing sealing device comprises a box body and a vacuum pump. The box body defines a cavity. A pumping end of the vacuum pump is communicated with the cavity. An outlet end of the vacuum pump is communicated with an air pipe arranged on an outer side of the box body. At least one attracting hole communicated with the cavity is on the box body. The vacuum pump is configured to pump air or water in the cavity, so the box body is fixed on the accident ship through atmospheric pressure or water pressure. The rescue devices are placed in the fixing sealing device. The remote control grippers are installed on the automatic lifting device. The remote control grippers are configured to grip the rescue devices for transfer operation.

The water navigation robot, the attracting device, the automatic lifting device, the vacuum pump, the remote control grippers, and the rescue devices are respectively electrically connected with the rescue terminal. The rescue terminal is wirelessly connected with the remote control terminal.

Furthermore, the attracting device is an electromagnet.

Furthermore, the automatic lifting device comprises a platform, a telescopic unit, a rotating unit, a lifting unit, a winch, a sling, and a lowering motor.

The lifting unit is installed on the water navigation robot. The rotating unit is installed on a lifting end of the lifting unit. The telescopic unit is installed on a rotating end of the rotating unit. The platform is installed on a telescopic end of the telescopic unit. The fixing sealing device is installed on the platform.

The winch is installed on the water navigation robot. The platform is connected with the winch through the sling. The winch is drive-connected with an output shaft of the lowering motor.

The telescopic unit, the rotating unit, the lifting unit, and the lowering motor are respectively electrically connected with the rescue terminal.

Furthermore, the water navigation robot comprises a U-shaped end. The winch is installed on an inner side of the U-shaped end. The platform is arranged in the U-shaped end.

Furthermore, a U-shaped sliding rail is installed on the U-shaped end of the water navigation robot. A counterweight block is installed on the U-shaped sliding rail. Electric control pulleys are installed on positions of the counterweight block where the counterweight block are connected with the U-shaped sliding rail. The counterweight block is slidably connected with the U-shaped sliding rail through the electric control pulleys.

The electric control pulleys are electrically connected with the rescue terminal.

Furthermore, the fixing sealing device further comprises a drainage device. The drainage device comprises a drainage pump, a drainage pipe, a water pumping pipe, and at least one drainage valve.

The box body defines a drainage hole, the water pumping pipe is arranged in the box body and is communicated with the drainage hole through the drainage pump. The drainage pipe is arranged on the outer side of the box body and is communicated with the drainage hole. The at least one drainage valve is installed on the drainage pipe and/or the water pumping pipe.

The drainage pump and the at least one drainage valve are respectively electrically connected with the rescue terminal.

Furthermore, the rescue devices comprise a drilling device, an electric welding device, a sealing steel plate and a transfer pipe.

The remote control grippers are configured to grip the drilling device, and the drilling device is configured to drill a hole on the accident ship. The hole is configured as a transfer hole.

The remote control grippers are configured to grip the transfer pipe and are configured to extend the transfer pipe into the transfer hole, so the accident ship is connected with the water navigation robot. The remote control grippers are configured to retract the transfer pipe after the transfer operation is completed.

The remote control grippers are configured to grip the sealing steel plate and are configured to insert the sealing steel plate into the transfer hole.

The remote control grippers are configured to grip the electric welding device. The electric welding device is configured to weld the sealing steel plate on the transfer hole to seal the transfer hole.

Furthermore, the drilling device is a water cutting drilling machine. The water cutting drilling machine comprises a high-pressure water generating device, a pumping pipe, a water drilling gun, a high-pressure pumping pipe, and a camera.

A water inlet end of the high-pressure water generating device is communicated with the pumping pipe. A water outlet end of the high-pressure water generating device is communicated with the water drilling gun through the high-pressure pumping pipe. The camera is installed on the water drilling gun; the camera is arranged a head of the water drilling gun.

The camera and the water drilling gun are respectively electrically connected with the rescue terminal.

Furthermore, the marine emergency rescue transfer system further comprises a cooling device. The cooling device is configured to cool the accident ship.

The cooling device comprises an onboard water pump, a compressed water tank, a water pipe, and a spray head. The onboard water pump is communicated with the compressed water tank. The compressed water tank is communicated with the spray head through the water pipe. The onboard water pump is configured to pump seawater for compression. The spray head is configured to spray cooling water mist to cool the accident ship.

The onboard water pump is electrically connected with the rescue terminal.

Furthermore, a plurality of monitoring cameras are installed on the water navigation robot, and the plurality of monitoring cameras are electrically connected with the rescue terminal.

The water navigation robot in the present disclosure is configured to transport the rescue devices to a predetermined position near the accident ship. The fixing sealing device is configured to fix the platform on the automatic lifting device to one side of the accident ship, so as to facilitate rescue operation of the rescue devices. The automatic lifting device is configured to lift the fixing sealing device, so as to realize the rescue operation on the water or underwater. The remote control grippers are configured to grip the rescue devices for the transfer operation to realize rescue transfer of the accident ship. The remote control terminal sends remote control commands to control operations of the marine emergency rescue transfer system through wireless network. The rescue terminal receives the remote control commands and controls each component to perform rescue operations. In the present disclosure, the water navigation robot and remote manipulation technology are adopted to carry out the transfer operation, which not only effectively protect personal safety of rescuers, but also improve rescue efficiency and reduce economic losses due to accident of the ship loading the hazardous chemicals.

1—water navigation robot; 11—attracting device; 2—automatic lifting device; 21—platform; 22—telescopic unit; 23—rotating unit; 24—lifting unit; 25—winch; 26—sling; 3—fixing sealing device; 31—box body; 311—cavity; 32—vacuum pump; 321—air pipe; 322—air valve; 33—drainage pump; 34—drainage pipe; 35—pumping pipe; 4—remote control gripper; 51—drilling device; 511—high-pressure water generating device; 512—pumping pipe; 513—water drilling gun; 514—high-pressure pumping pipe; 515—camera; 52—electric welding device; 53—filling auxiliary device; 54—transfer pipe; 55—filling pipe; 56—extending pipe connector; 561—sealing ring; 562—groove; 563—nut hole; 57—sealing steel plate; 6—rescue terminal; 71—sliding rail; 72—counterweight block; 73—electric control pulley; 81—water pipe; 91—motor; 92—valve plate; 10—accident ship; 20—rescue ship; 30—barge; 40—inert gas cabin 50—liquid storage container.

DETAILED DESCRIPTION

Optional embodiments of the present disclosure are specifically described below with reference to the accompanying drawings. The accompanying drawings constitute a part of the present disclosure, and together with the embodiments of the present disclosure, are used to explain the principles of the present disclosure but are not intend to limit the scope of the present disclosure.

Embodiment 1

Figure 1:
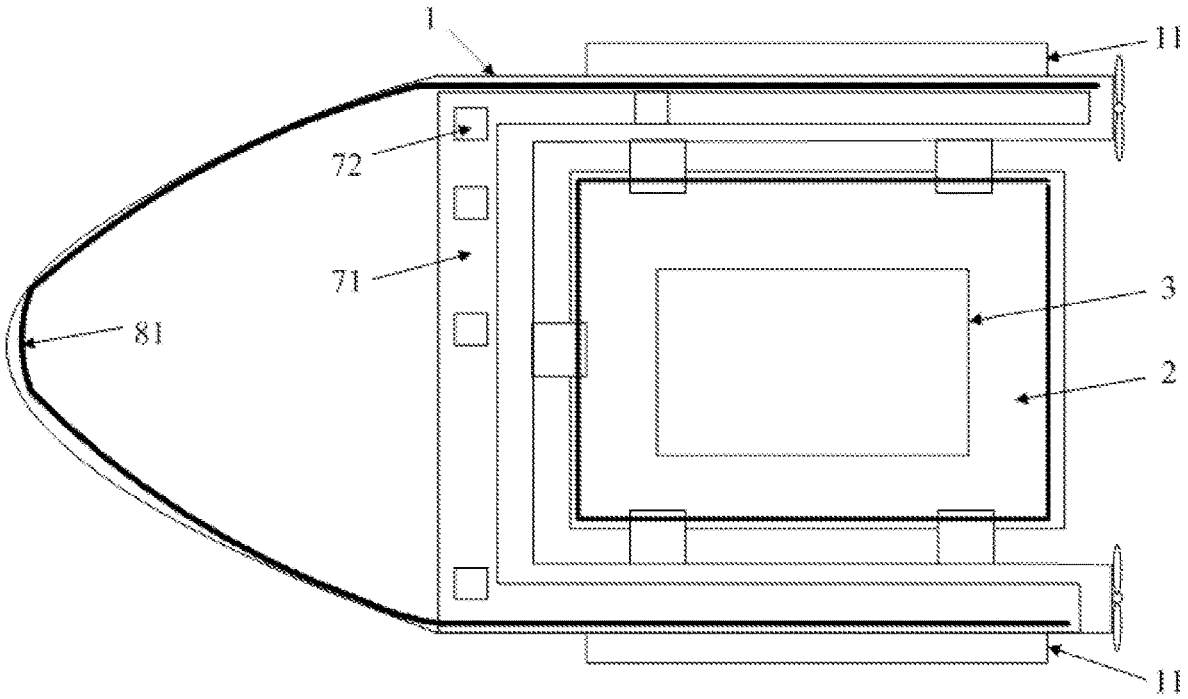
FIG. 1 is a top schematic diagram of a marine emergency rescue transfer system according to one embodiment of the present disclosure.
Figure 2:
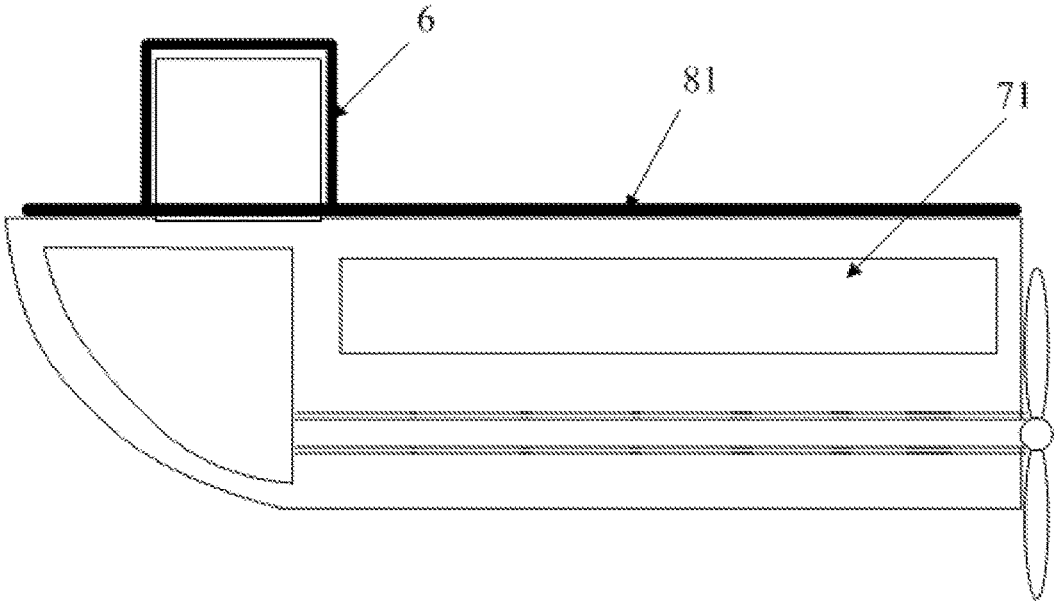
FIG. 2 is a side schematic diagram of a marine emergency rescue transfer system according to one embodiment of the present disclosure.
Figure 3:
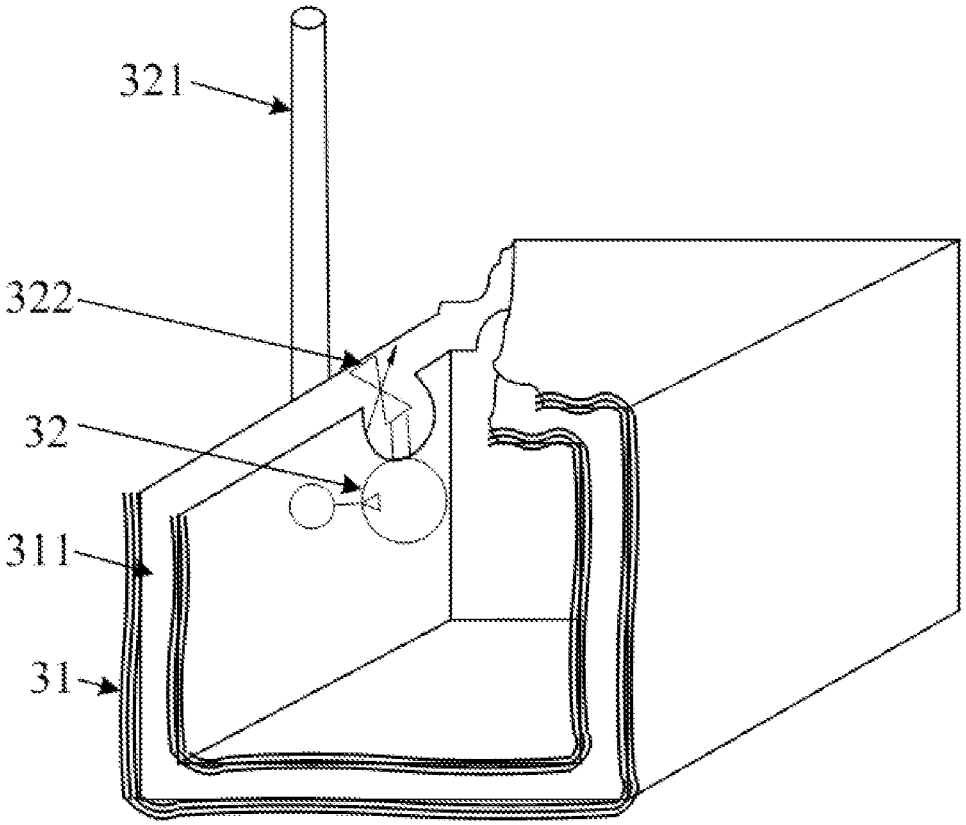
FIG. 3 is a schematic diagram of a fixing sealing device according to one embodiment of the present disclosure.

As shown in FIGS. 1-3, in the embodiment, the present disclosure provides a marine emergency rescue transfer system (system in short hereafter). The marine emergency rescue transfer system comprises a water navigation robot 1, an automatic lifting device 2, a fixing sealing device 3, remote control grippers 4, rescue devices, a rescue terminal 6, and a remote control terminal.

An attracting device 11 configured to attach and fix with an accident ship 10 is installed on one side of the water navigation robot 1. The automatic lifting device 2 is installed on the water navigation robot 1. The fixing sealing device 3 is installed on the automatic lifting device 2. The automatic lifting device is installed on the automatic lifting device. The fixing sealing device 3 comprises a box body 31 and a vacuum pump 32. The box body 31 defines a cavity 311. A pumping end of the vacuum pump 32 is communicated with the cavity 311. An outlet end of the vacuum pump 32 is communicated with an air pipe 321 arranged on an outer side of the box body. At least one attracting hole communicated with the cavity 311 is on the box body 31. The vacuum pump 32 is configured to pump air or water in the cavity 311, so the box body 31 is fixed on the accident ship 10 through atmospheric pressure or water pressure. The rescue devices are placed in the fixing sealing device 3. The remote control grippers 4 are installed on the automatic lifting device 2. The remote control grippers 4 are configured to grip the rescue devices for transfer operation.

The water navigation robot 1, the attracting device 11, the automatic lifting device 2, the vacuum pump 32, the remote control grippers 4, and the rescue devices are respectively electrically connected with the rescue terminal 6. The rescue terminal 6 is wirelessly connected with the remote control terminal.

The water navigation robot 1 in the present disclosure is configured to transport the fixing sealing device 3 and the rescue devices (such as a drilling device 51, transfer pipe 54, etc.) to a predetermined position near the accident ship 10. The fixing sealing device 3 is a vacuum fixing sealing device 3. The fixing sealing device 3 is configured to fix the platform 21 on the automatic lifting device 2 to one side of the accident ship 10. The automatic lifting device 2 is configured to lift the fixing sealing device 3, so as to realize the rescue operation on the water or underwater. The remote control grippers 4 are configured to grip the rescue devices for the transfer operation to realize rescue transfer of the accident ship 10. For example, the remote control grippers 4 are configured to grip the drilling device 51 to drill a hole, and are configured to transfer liquid hazardous chemicals in a liquid cabin of the accident ship 10 to a barge 30 through the transfer pipe 54, etc., to realize rescue and transfer. The remote control terminal sends remote control commands to control operations of the marine emergency rescue transfer system through wireless network. The rescue terminal 6 receives the remote control commands and controls each component to perform rescue operations. The remote control terminal and the rescue terminal 6 can be an industrial computer, a computer, or the like.

Specifically, as shown in FIG. 3, the pumping end of the vacuum pump 32 is communicated with the cavity 311 of the box body 31. The outlet end of the vacuum pump 32 is communicated with the air pipe 321 arranged on an outer side of the box body. Air valves 322 are arranged on the pumping end of the vacuum pump 32 and the outlet end of the vacuum pump 32. The air pipe 321 connected to the vacuum pump 32 is a bendable hose with a diameter of 4 inches (about 101.6 mm). A floating ring is arranged at a top portion of the air pipe, making an opening of the air pipe out of the water surface. A water blocking valve is arranged at the top portion of the air pipe to prevent seawater from pouring into the air pipe 321. The material of a rubber sealing ring of the vacuum pump 32 is selected from a silicone rubber, a nitrile rubber or other high temperature resistant soft materials that is used for sealing. The vacuum pump 32 is mainly configured to extract air in a compartment of the box body 31, and use the atmospheric pressure or the water pressure to fix the fixing sealing device 3 on the accident ship 10.

Based on an application of robots and remote control, the present disclosure proposes the marine emergency rescue transfer system for ships loading liquid hazardous chemicals. The water navigation robot and remote manipulation technology are adopted to carry out the transfer operation, which not only effectively protect personal safety of rescuers, but also improve rescue efficiency and reduce economic losses due to accident of the ship loading the hazardous chemicals.

Optionally, the attracting device 11 is an electromagnet.

The water navigation robot 1 is attached to the accident ship 10 by the electromagnet, and the on/off of the electromagnet is controlled by the rescue terminal 6, so that connection and disconnection of the water navigation robot 1 and the accident ship 10 are controlled.

Figure 4:
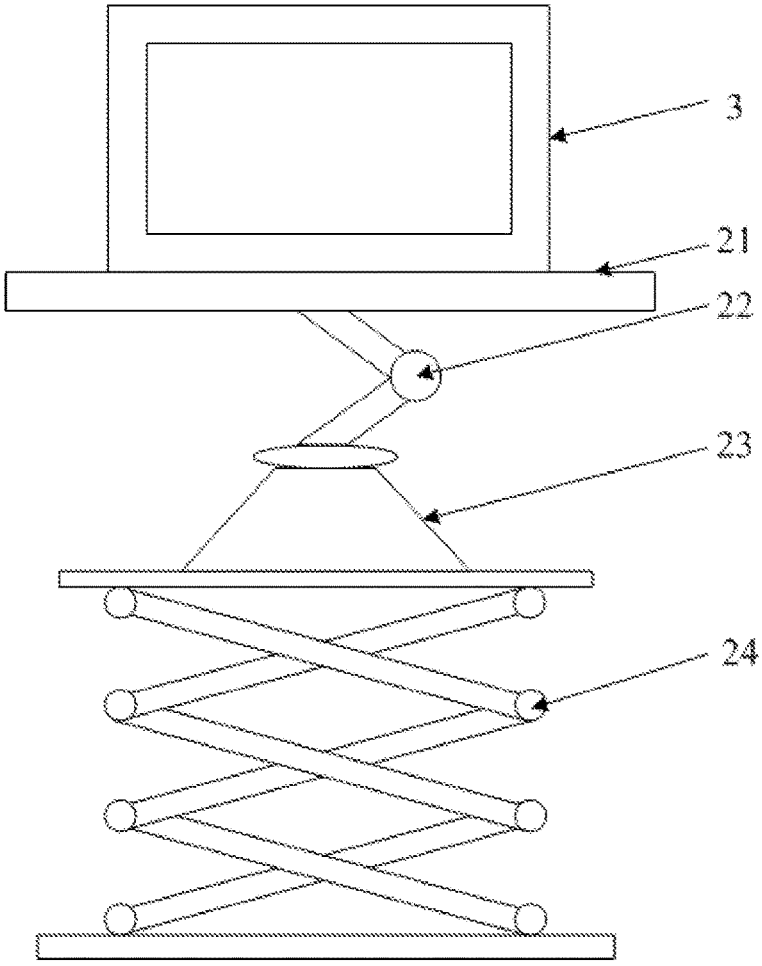
FIG. 4 is a schematic diagram of an automatic lifting device according to one embodiment of the present disclosure.
Figure 5:
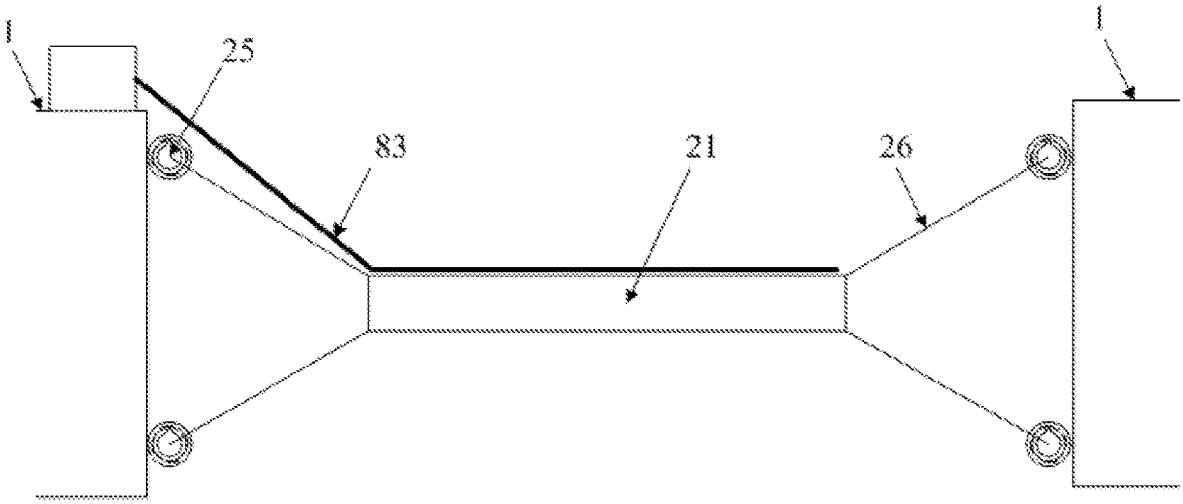
FIG. 5 is schematic diagram of an installation structure of the automatic lifting device in FIG. 4.

Optionally, as shown in FIGS. 4 and 5, the automatic lifting device 2 comprises a platform 21, a telescopic unit 22, a rotating unit 23, a lifting unit 24, a winch 25, a sling 26, and a lowering motor.

The lifting unit 24 is installed on the water navigation robot 1, the rotating unit 23 is installed on a lifting end of the lifting unit 24. The telescopic unit 22 is installed on a rotating end of the rotating unit 23. The platform 21 is installed on a telescopic end of the telescopic unit 24. The fixing sealing device 3 is installed on the platform 21.

The winch 25 is installed on the water navigation robot 1. The platform 21 is connected with the winch 25 through the sling 26. The winch 25 is drive-connected with an output shaft of the lowering motor.

The telescopic unit 22, the rotating unit 23, the lifting unit 24, and the lowering motor are respectively electrically connected with the rescue terminal 6.

The automatic lifting device 2 is configured to lift the platform 21 to a predetermined drilling position when rescue operations such as drilling are required. The telescopic unit 22, the rotating unit 23, and the lifting unit 24 adopts conventional technologies. For example, the telescopic unit 22 is an electric push rod, the rotating unit 23 is a rotating motor, and the lifting unit 24 is an air cylinder. The lowering motor is configured to control lowering of the platform 21. When underwater drilling is required, the platform 21 needs to be lowered to the predetermined drilling position. The lowering motor rotates to drive the winch 25 to rotate, and the winch 25 rotates to realize retraction and release of the sling 26, thereby realizing a lowing control of the platform 21.

Optionally, as shown in FIG. 1, the water navigation robot 1 comprises a U-shaped end. The winch 25 is installed on an inner side of the U-shaped end. The platform 21 is arranged in the U-shaped end.

Arrangement of the U-shaped end facilitates installation and lifting control of the platform 21

Figure 6:
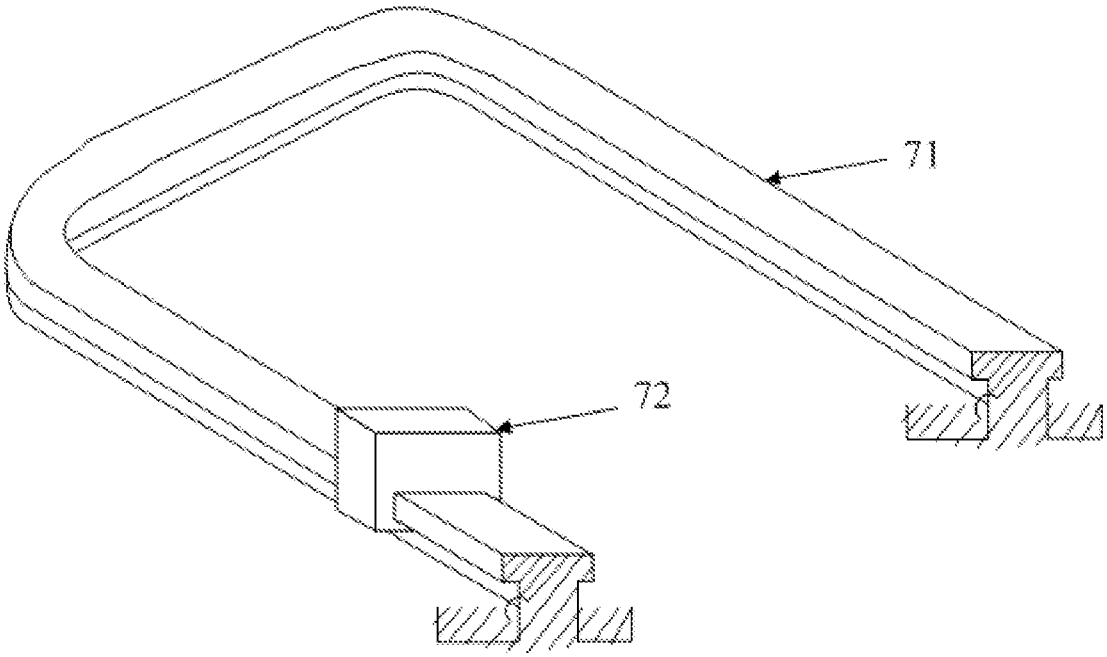
FIG. 6 is a schematic diagram showing connection of a U-shaped sliding rail and a counterweight block of the marine emergency rescue transfer system according to one embodiment of the present disclosure.
Figure 7:
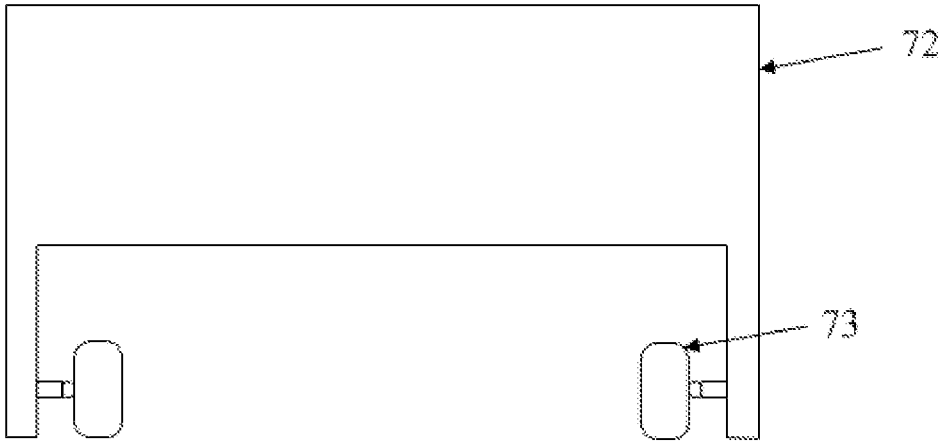
FIG. 7 is a schematic diagram of the counterweight block of the marine emergency rescue transfer system according to one embodiment of the present disclosure.

Optionally, as shown in FIGS. 6 and 7, a U-shaped sliding rail 71 is installed on the U-shaped end of the water navigation robot 1. A counterweight block 72 is installed on the U-shaped sliding rail 71. Electric control pulleys 73 are installed on positions of the counterweight block 72 where the counterweight block 72 are connected with the U-shaped sliding rail 71. The counterweight block 72 is slidably connected with the U-shaped sliding rail 71 through the electric control pulleys 73.

The electric control pulleys 73 are electrically connected with the rescue terminal 6.

The electronically controlled pulleys 73 are arranged on a lower side of the counterweight block 72 and the electronically controlled pulleys 73 are movable in the U-shaped sliding rail 71. A center of gravity and stability of the water navigation robot 1 is adjusted by controlling sliding of the counterweight block 72.

Figure 8:
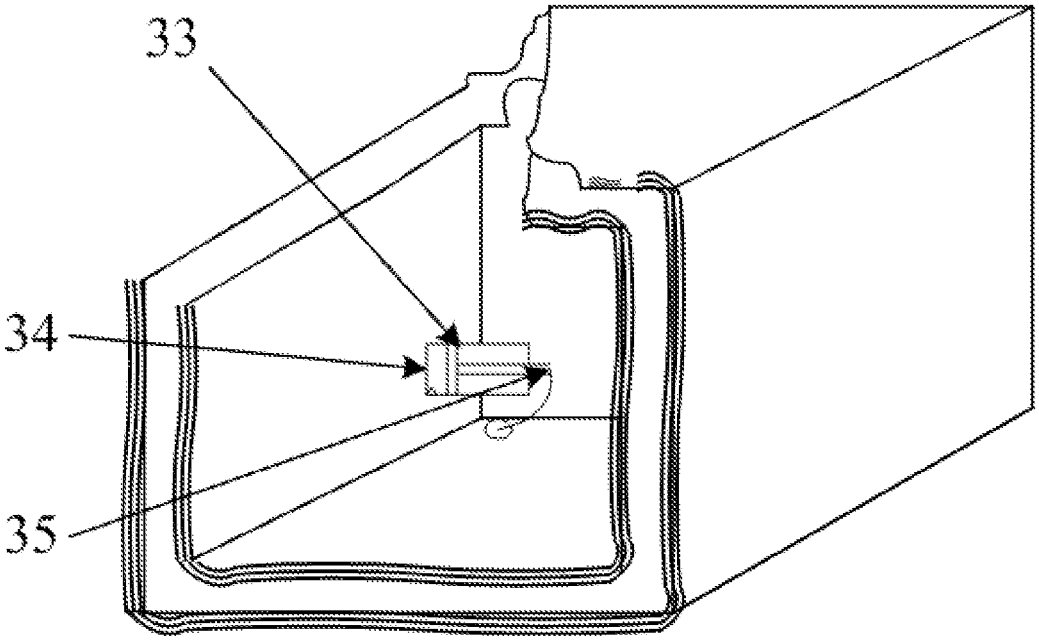
FIG. 8 is a schematic diagram of a drainage device of the marine emergency rescue transfer system according to one embodiment of the present disclosure.

Optionally, as shown in FIG. 8, the fixing sealing device 3 further comprises a drainage device. The drainage device comprises a drainage pump 33, a drainage pipe 34, a water pumping pipe 35, and a drainage valve.

The box body 31 defines a drainage hole, the water pumping pipe 35 is arranged in the box body 31 and is communicated with the drainage hole through the drainage pump 33. The drainage pipe 34 is arranged on the outer side of the box body 31 and is communicated with the drainage hole. The at least one drainage valve is installed on the drainage pipe and/or the water pumping pipe.

The drainage pump 33 and the at least one drainage valve are respectively electrically connected with the rescue terminal 6.

After the fixing sealing device 3 is fixed on one side of the accident ship 10, the water in spaces of the rescue devices is extracted through the water pumping pipe 35 of the drainage device. The water is drained through the drainage pipe 34 and the drainage hole, which facilitates the use of rescue devices and the grasping of the remote control grippers 4.

Figure 9:
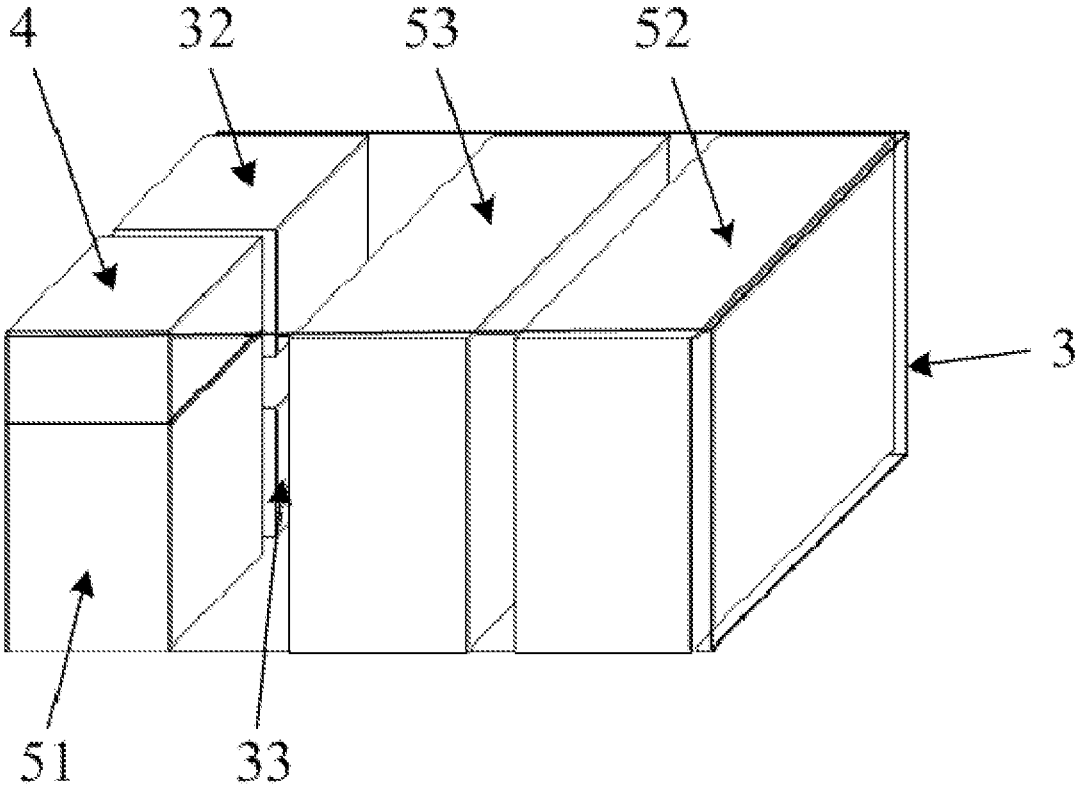
FIG. 9 is a schematic diagram showing arrangements of the rescue devices in the fixing sealing device of the marine emergency rescue transfer system according to one embodiment of the present disclosure.
Figure 10:
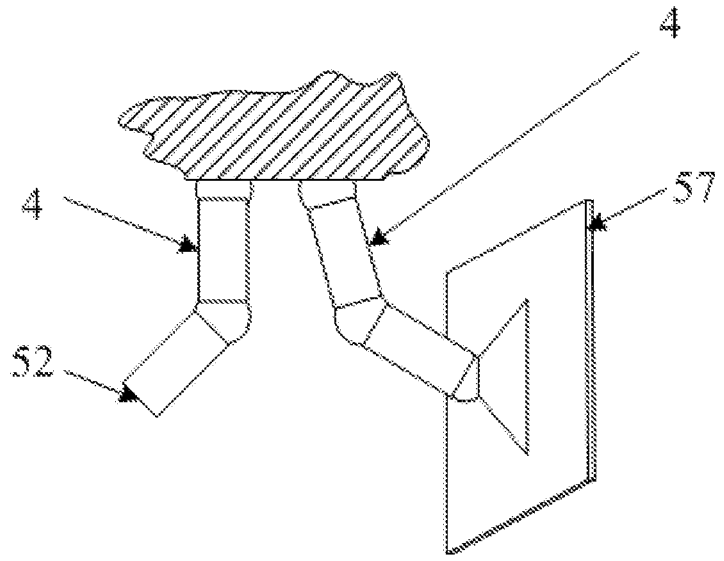
FIG. 10 is a schematic diagram of an electric welding device of the marine emergency rescue transfer system according to one embodiment of the present disclosure.
Figure 11:
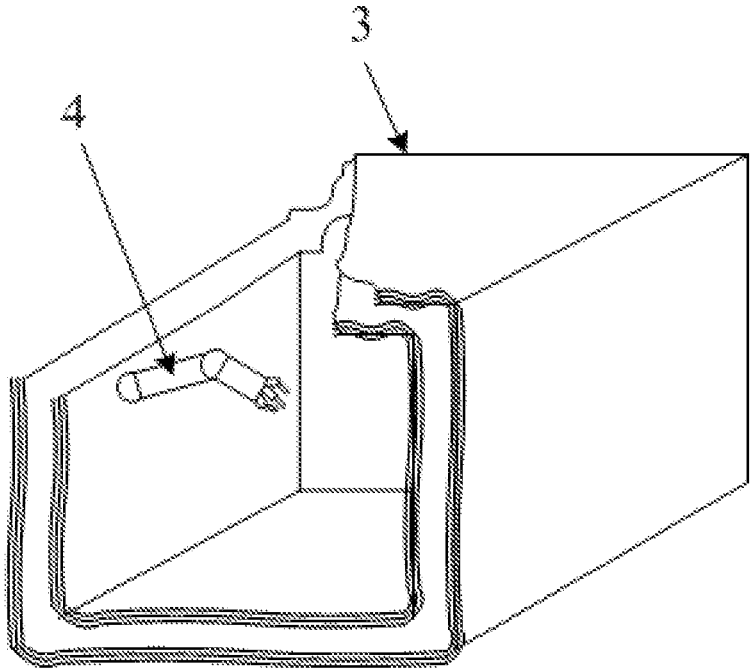
FIG. 11 is a schematic diagram showing installation of a remote control gripper of the marine emergency rescue transfer system according to one embodiment of the present disclosure.

Optionally, as shown in FIGS. 9-11, the rescue devices comprise a drilling device 51, an electric welding device 52, a sealing steel plate 57, and a transfer pipe 54.

The remote control grippers 4 are configured to grip the drilling device 51, and the drilling device 51 is configured to drill a hole on the accident ship 10. The hole is configured as a transfer hole.

The remote control grippers 4 are configured to grip the transfer pipe 54 and are configured to extend the transfer pipe 54 into the transfer hole, so the accident ship 10 is connected with a rescue ship. The remote control grippers 4 are configured to retract the transfer pipe 54 after the transfer operation is completed.

The remote control grippers are configured 4 to grip the sealing steel plate 57 and are configured to insert the sealing steel plate 57 into the transfer hole.

The remote control grippers 4 are configured to grip the electric welding device 52. The electric welding device 52 is configured to weld the sealing steel plate 57 on the transfer hole to seal the transfer hole.

The drilling device is an ultra-high pressure water cutting drilling machine configured to perform drilling operations on the one side of the accident ship 10. The remote control grippers 4 are configured to grip the extending pipes and insert them into the transfer hole, so that the liquid hazardous chemicals in the liquid cabin of the accident ship 10 are transferred to the barge 30. After the transfer is completed, the electric welding device 52 seals the transfer hole by welding the sealing steel plate 57.

Figure 12:
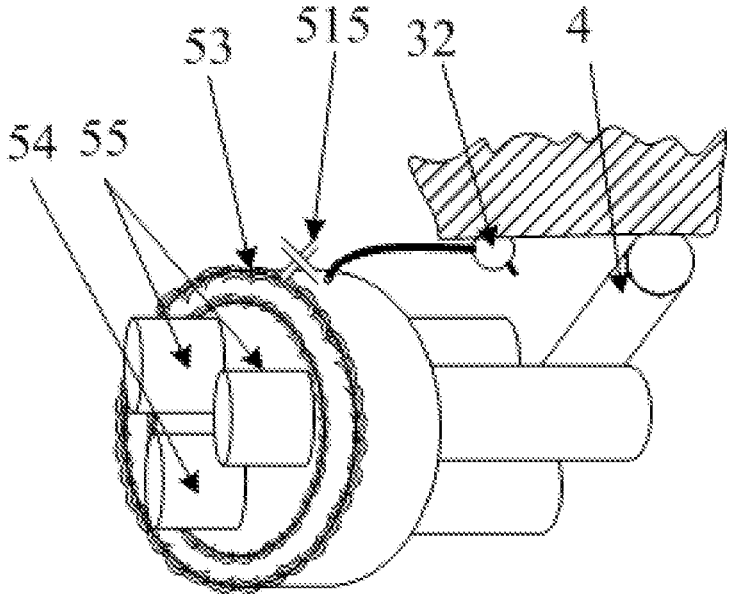
FIG. 12 is a schematic diagram showing installation of a filling auxiliary device of the marine emergency rescue transfer system according to one embodiment of the present disclosure.

As shown in FIGS. 8 and 12, the rescue devices further comprise a filling auxiliary device 53 configured for auxiliary installation of the drilling device 51 and various pipes, the pipes and the filling auxiliary device 53 are combined into a whole. The filling auxiliary device 53 is installed on an inner top wall of the fixing sealing device 3.

Figure 13:
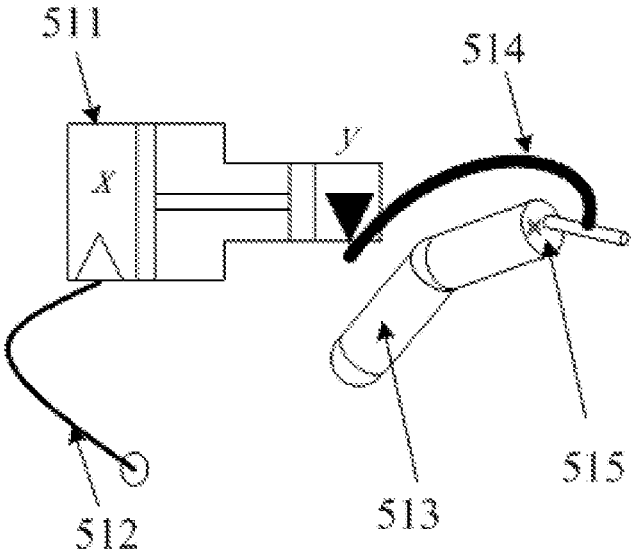
FIG. 13 is a schematic diagram of a drilling device of the marine emergency rescue transfer system according to one embodiment of the present disclosure.

Optionally, as shown in FIG. 13, the drilling device 51 is a water cutting drilling machine. The water cutting drilling machine comprises a high-pressure water generating device 52, a pumping pipe 512, a water drilling gun 513, a high-pressure pumping pipe 514, and a camera 515.

A water inlet end of the high-pressure water generating device 52 is communicated with the pumping pipe 512. A water outlet end of the high-pressure water generating device 52 is communicated with the water drilling gun 513 through the high-pressure pumping pipe 514. The camera 515 is installed on the water drilling gun 514. The camera 515 is arranged a head of the water drilling gun 514.

The camera 515 and the water drilling gun 513 are respectively electrically connected with the rescue terminal 6.

The camera 515 is configured to shoot drilling scenes, so that the remote control terminal accurately adjusts the drilling position.

Optionally, as shown in FIGS. 1 and 2, the marine emergency rescue transfer system further comprises a cooling device. The cooling device is configured to cool the accident ship 10.

The cooling device comprises an onboard water pump, a compressed water tank, a water pipe 81, and a spray head. The onboard water pump is communicated with the compressed water tank. The compressed water tank is communicated with the spray head through the water pipe. The onboard water pump is configured to pump seawater for compression. The spray head is configured to spray cooling water mist to cool the accident ship 10.

The onboard water pump is electrically connected with the rescue terminal 6.

In the system, the cooling device configured to generate water mist is arranged on the water navigation robot 1. The cooling device uses the onboard water pump to compress the seawater to the water pipe 81 and the spray head fixed to the water navigation robot 1, forming the water mist that cools the accident ship 10 and the surrounding environment.

Furthermore, a plurality of monitoring cameras 515 are installed on the water navigation robot 1, and the plurality of monitoring cameras 515 are electrically connected with the rescue terminal 6.

Some monitoring cameras 515 for real-time monitoring are installed around a top portion of the water navigation robot 1 to monitor the surrounding environment of the water navigation robot 1. A lighting system and some monitoring cameras 515 are arranged in the fixing sealing device 3. The monitoring cameras 515 monitor an entire operating space of the box body 31. The monitor cameras 515 are arranged on eight corners inside the box body 31 of the fixing sealing device 3, and the monitoring cameras 515 are rotatable. Furthermore, the rest of the monitoring cameras 515 are installed on the drilling device 51 and the electric welding device 52. The video image signals sent by the monitoring cameras 515 are transmitted to the remote control terminal of the rescue ship 20 through a signal cable and radio transmission.

Figure 14:
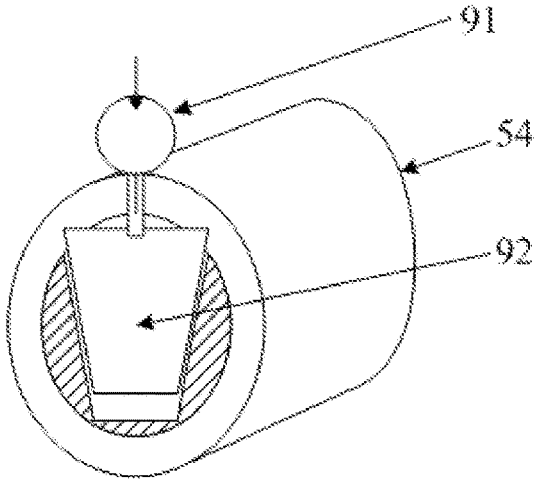
FIG. 14 is a schematic diagram of a control valve in a transfer pipe of the marine emergency rescue transfer system according to one embodiment of the present disclosure.
Figure 15A:
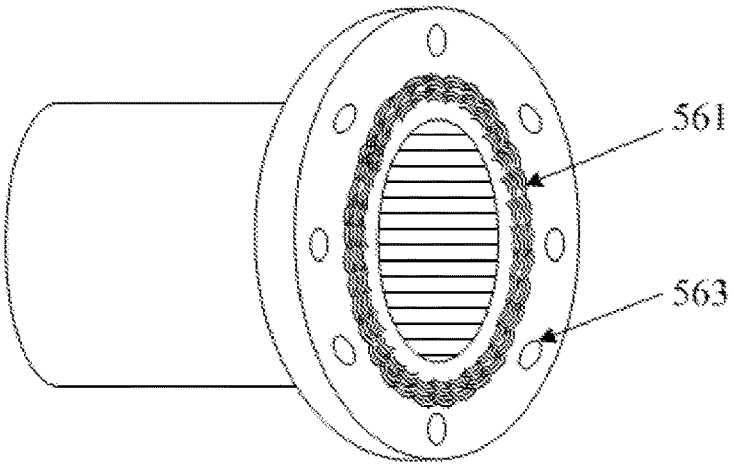
FIG. 15*a* is a schematic diagram of a first end of an extending pipe connector of the marine emergency rescue transfer system according to one embodiment of the present disclosure.
Figure 15B:
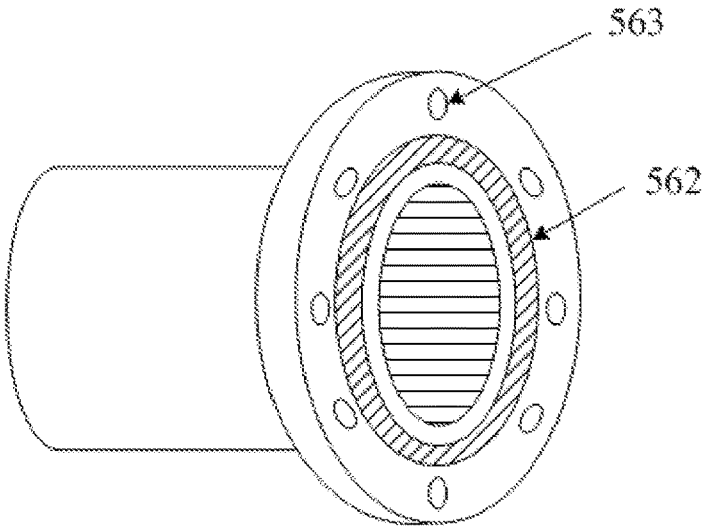
FIG. 15*b* is a schematic diagram of a second end of the extending pipe connector of the marine emergency rescue transfer system according to one embodiment of the present disclosure.

The rescue devices further comprise filling pipes 55 and the transfer pipeline 54, and the filling pipes 55 comprise a liquid filling pipe and an air filling pipe. The filling pipes 55 are configured to add water or filling inert gas into the liquid cabin of the accident ship 10. The filling pipes 55 are flexible special hoses. The transfer pipe 54 is configured to transfer the liquid hazardous chemicals. The transfer pipe 54 is a flexible special hose. An extending pipe is arranged on an opening of each pipe and each pipe comprises an electronic control valve. As shown in FIG. 14, each electronic controlled valve comprises a motor 91 and a valve plate 92. Each motor 91 is connected with a corresponding valve plate 92 and controls the corresponding valve plate 92 to rotate, thereby realizing the opening and closing of each electronic controlled valve. An extending pipe connector 56 is arranged on any one of the extending pipes, the filling pipes 55, and the transfer pipe 54. The extending pipe connectors 56 are configured to connect the extending pipes, the filling pipes 55, and the transfer pipe 54. As shown in FIGS. 15*a* and 15*b*, a sealing ring 561 is arranged on a first end of each of the extending pipe connectors 56. A groove 562 is provided on a second end of each of the extending pipe connectors 56. Each groove 562 is configured to match with a corresponding sealing ring 561. And each of the extending pipe connectors 56 at both ends are provided with a groove 562. Nut holes 563 are on the first end and second end of each of the extending pipe connectors 56. Each of the extending pipe connectors 56 is connected with a corresponding extending pipe connector 56 through the nut holes 563 on the first end and second end of each of the extending pipe connectors 56, which realizes connection of the pipes when the pipes are extended.

After a marine accident of a ship loading the liquid hazardous chemicals occurs, a transfer plan should be formulated according to the situation at the accident site. First, a risk assessment of the accident site is conducted. A main purpose of the evaluation is to determine whether the transfer operation can be carried out on the premise of ensuring safety. The risk assessment comprises damage of the accident ship, environment of the sea area where the accident ship is located, and situation of the liquid hazardous chemicals. After it is determined that the transfer operation can be carried out, the amount of transfer should be calculated, and rescue devices such as the transfer pipe 54 with suitable diameter should be selected according to actual situation. It is also necessary to calculate the accident ship's stability and other ship data, and formulate a safe and effective transfer process and security plan. The system is configured to carry out the transfer rescue after the transfer process and the security plan are formulated.

Figure 16A:
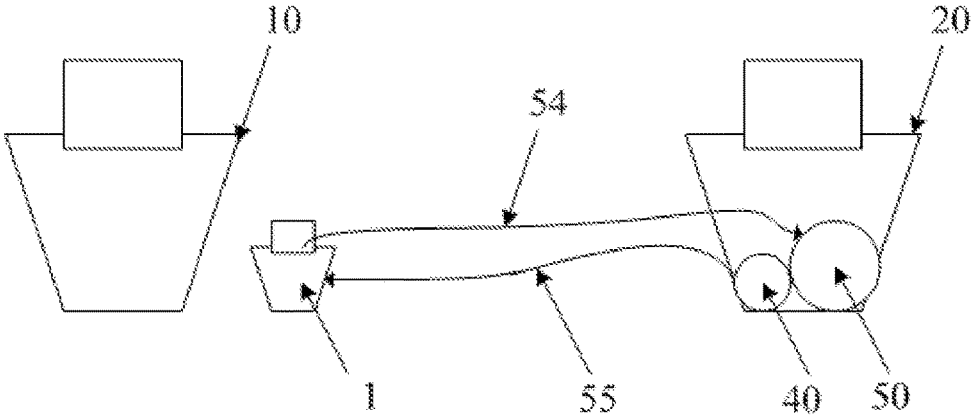
FIG. 16*a* is a first application scenario diagram of the marine emergency rescue transfer system according to one embodiment of the present disclosure.
Figure 16B:
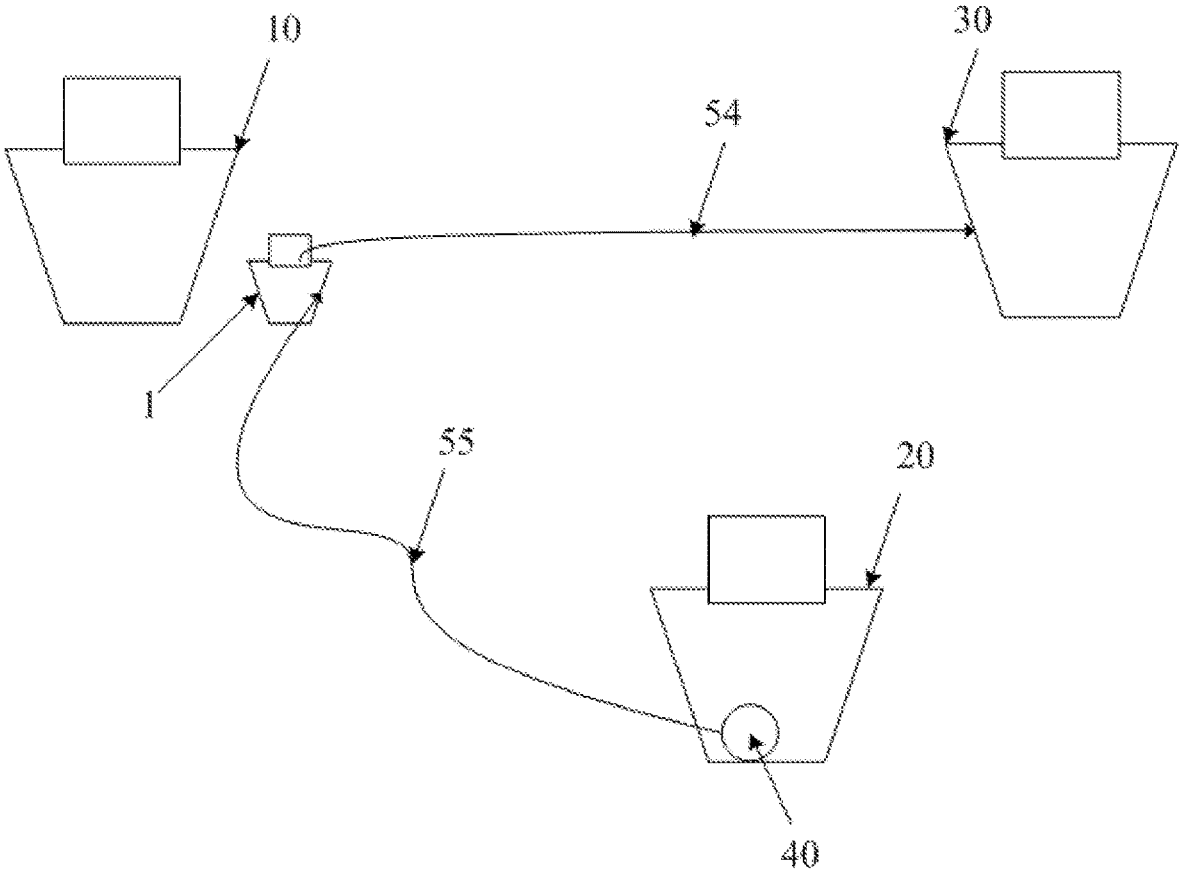
FIG. 16*b* is a second application scenario diagram of the marine emergency rescue transfer system according to one embodiment of the present disclosure.

As shown in FIGS. 16*a* and 16*b*, in the emergency transfer, there are two arrangements of marine emergency rescue transfer devices: the rescue ship 20 itself is configured as the barge 30, and the rescue ship 20 is not configured as the barge 30. After formulating a transfer plan and transporting all required equipment to the accident site, the transfer operation begins. When the rescue ship 20 and the barge 30 are two separate devices, the transfer operation comprises steps:

S1: making the rescue ship 20 to be located on an upwind side of the accident ship 10, and making the barge 30 to be located on the upwind side of the rescue ship 20; keeping running of the rescue ship 20 and the barge 30 during a rescue process to prevent the rescue ship 20 and the barge 30 from colliding; connecting the filling pipes 55, the transfer pipe 54, and all electrical circuits to the rescue ship 20; performing functional tests on remotely operated equipment such as the water navigation robot 1, the fixing sealing device 3, and the drilling device; after testing all remotely operated equipment to work properly, placing devices used on the accident ship 10 on the water navigation robot 1; and using a hoist to place the accident ship 10 on the water;

S2: according to the transfer plan, remotely controlling the water navigation robot 1 to approach the accident ship 10, and turning on the cooling device of the water navigation robot 1 configured to generate water mist (that is, the onboard water pump pumps the seawater, and the water pipe and the spray head spray the seawater on the water navigation robot 1 to achieve cooling effect); after approaching the accident ship 10, attaching the water navigation robot to the one side of the accident ship 10 by the electromagnet;

When the water navigation robot 1 sails to the accident ship 10, the personnel on the rescue ship 20 sends out all pipes and lines in a safe and orderly manner.

S3: drilling the transfer hole above the water surface: transporting the fixing sealing device 3, the drilling device, and rescue devices such as the transfer pipe 54 arranged in the fixing sealing device 3 to an upper half of the liquid cabin of the accident ship 10 by the automatic lifting device 2 of the water navigation robot; and fixing the rescue devices in the drilling position of the transfer hole by the vacuum fixing sealing device 3; turning on the vacuum pump 32, so the entire fixing sealing device 3 is fixed at the drilling position;

If the transfer hole is drilled underwater, it is necessary to use the sling 26 to lower the fixing sealing device 3, the drilling device, and the transfer pipeline 54 to a position of one side of the liquid cabin close to the bottom of the liquid cabin. Then, the vacuum fixing sealing device 3 is configured to fix the rescue devices in the designated position. Fixing method is as follow: inflating the air into the box body 31 of the fixing sealing device 3 to remove the water in the box body 31. The vacuum pump 32 is turned on, and the fixing sealing device 3 is fixed to the drilling position. After fixing, the water in the box body 31 of the fixing sealing device 3 is drained by the drainage device.

S4: remotely controlling the drilling device 51 to carry out the drilling operation according to the real-time video image sent back to the rescue ship 20 by the monitoring cameras 515 arranged in the fixing sealing device 3;

A size of the transfer hole is less than a size of the transfer hole and is large enough for extending of all required pipes. The accident ship 10 may be a single-layer hull or a double-layer hull. During the drilling operation, the hull needs to be completely drilled. The double-layer hull usually adopts above water drilling.

S5: installing the sealing steel plate and the require pipes;

The personnel watches the real-time video showing an interior of the fixing sealing device 3, and controls the remote control grippers 4, and controls the extending pipe of the transfer pipe 54 to extend into the transfer hole. The personnel controls the filling auxiliary device 53, so the sealing steel plate completely covers the transfer hole and is close to the one side of the accident ship. Then the vacuum pump 32 is turned on.

For transfer of the liquid hazardous chemicals that are insoluble in water and has a density greater than a density of the water, if a above water drilling method is adopted, the transfer pipe 54 should be extended into a bottom portion of the liquid cabin; and the liquid filling pipe should just be inserted into the transfer hole. If a underwater drilling method is adopted, the transfer pip 54 is just extended into the transfer hole. Before the transfer device is launched, the required extending pipes must be installed.

For transfer of the liquid hazardous chemicals that are insoluble in water and has a density less than that the density of the water, the above water drilling method is generally adopted, and the transfer pipe 54 is just extended into the transfer hole.

For transfer of the liquid hazardous chemicals that are soluble in water, if the above water drilling method is adopted, the transfer pipe 54 should be extended into the bottom portion of the liquid cabin. If the underwater drilling method is adopted, the transfer pip 54 is just extended into the transfer hole.

S6: opening valves of the pipes between the rescue ship 20 and the accident ship 10, and opening valves of the pipes between the rescue ship 20 and the barge 30; loading the accident ship 10 with water or filling the liquid cabin with inert gas;

When the transfer of the liquid hazardous chemicals starts, and the liquid hazardous chemicals are transferred into the liquid storage container 50 of the rescue ship 20 or the transfer ship 30. The inert gas is stored in the inert gas cabin 40 of the rescue ship 20.

S7: monitoring liquid composition and flow data of the transferred liquid hazardous chemicals in real time by a liquid composition monitoring device arranged at a connecting position of the transfer pipe 54 and the liquid cabin of the rescue ship 20; and When the transfer is performed by loading the water, if it is found that the liquid hazardous chemicals are no longer transferred, but water, stop loading the water, close the valves of the pipes, and open check valves.

When the transfer is performed by loading the inert gas, if it is found that there is no more liquid hazardous chemicals flowing out, stop the filling of the inert gas, close the valves of the pipes, and open the check valves.

S8: after completing the transfer of the liquid hazardous chemicals in one liquid cabin of the accident ship 10, pulling out all the pipes and sealing the transfer hole with the sealing steel plate; recovering the devices such as fixing sealing device, the drilling device, and the require pipes onto the water navigation robot 1 by the automatic lifting device 2 of the water navigation robot 1; then controlling the water navigation robot 1 to go to a position of a next liquid cabin and repeat the operation according to the above step until the transfer is completed in all liquid cabins.

During implementation of the entire emergency transfer operation, some safeguard measures need to be implemented to ensure smooth progress of the entire work. The safeguard measures mainly comprise cooling, environmental protection, personnel protection, and emergency evacuation.

For a fire accident on a ship loading hazardous chemicals at sea, cooling is an indispensable part of the entire emergency rescue and transfer work. After the water navigation robot 1 approaches the fire ship, high temperature generated by the combustion may affect the work of the water navigation robot 1, so the surrounding environment is cooled to ensure that the water navigation robot 1 can work normally. When drilling the transfer hole, friction and cutting between the drilling device and a metal ship plate may generate a lot of heat, which needs to be cooled in time to avoid burning of surrounding combustibles due to excessive temperature.

During the transfer, there may be leakage of liquid hazardous chemicals, which requires good measures for environmental protection. If leakage occurs during the transfer process, the transfer of the liquid hazardous chemicals should be stopped quickly and all pipes should be closed to check a leaking place and carry out a plugging work. For the leaked liquid hazardous chemicals, if they are floating on a sea surface, equipment such as oil booms are adopted to limit the leaked liquid hazardous chemicals within a certain range, and a recovery equipment is adopted to recover and store the leaked liquid hazardous chemicals. If the density of the leaked liquid hazardous chemicals is greater than the density of seawater, and if an amount of leaked liquid hazardous chemicals is large, professional salvage work is required. If the leaked liquid hazardous chemicals are dissolved in water, a suitable neutralizer needs to be used to neutralize the leaked liquid hazardous chemicals. In addition to making a good post-leakage treatment plan, it is necessary to take protective measures. All device and equipment should be checked regularly to ensure normal use. All of the pipes need to be leak-proof; all installations and all of the devices and equipment should not cause damage to the environment.

The primary task of ensuring the safety of personnel is to wear protective equipment in all work. All the work of the emergency rescue transfer is that the operator performs remote operation of the equipment on the rescue mother ship 20, which also effectively ensures the safety of the rescuers.

Ensuring the safety of people's lives is the top priority. The personnel is required to wear protective equipment during all work. All the work of the emergency rescue transfer carried out by the related devices is performed remotely by the personnel on the rescue ship 20, which also effectively ensures the safety of the personnel.

When an accident occurs, the first thing to do is to stop all transfer work and close all of the pipes to prevent the accident on the accident ship 10 from affecting the rescue ship and the rescue personnel. If the impact of the accident is not great, the rescue devices are evacuated. All of the pipes are withdrawn and the transfer hole is sealed and all these devices are withdrawn to the rescue ship 20 by the water navigation robot 1. An emergency cut-off procedure is set on the rescuer ship 20. When a serious accident that may affect the rescue ship 20 occurs, the emergency cut-off procedure is activated, and all external devices of the rescue ship 20 including the water navigation robot 1, the drilling device, and the transfer pipe 54 are discarded to ensure the safety of the rescue ship 20.

The above descriptions are only optional embodiments of the present disclosure, and do not limit the protection scope of the present disclosure. Any changes or substitutions that can be easily conceived by those skilled in the art within the technical scope disclosed by the present disclosure shall fall within the protection scope of the present disclosure.

What is claimed is:

1. A marine emergency rescue transfer system, comprising:

a water navigation robot;

an automatic lifting device;

a fixing sealing device;

remote control grippers;

rescue devices;

a rescue terminal; and a remote control terminal;

wherein an attracting device configured to attach and fix with an accident ship is installed on one side of the water navigation robot; the automatic lifting device is installed on the water navigation robot; the fixing sealing device is installed on the automatic lifting device; the automatic lifting device is installed on the automatic lifting device; the fixing sealing device comprises a box body and a vacuum pump; the box body defines a cavity; a pumping end of the vacuum pump is communicated with the cavity; an outlet end of the vacuum pump is communicated with an air pipe arranged on an outer side of the box body; at least one attracting hole communicated with the cavity is on the box body; the vacuum pump is configured to pump air or water in the cavity, so the box body is fixed to the accident ship through atmospheric pressure or water pressure; the rescue devices are placed in the fixing sealing device; the remote control grippers are installed on the automatic lifting device; the remote control grippers are configured to grip the rescue devices for transfer operation;

wherein the water navigation robot, the attracting device, the automatic lifting device, the vacuum pump, the remote control grippers, and the rescue devices are respectively electrically connected with the rescue terminal; the rescue terminal is wirelessly connected with the remote control terminal.

2. The marine emergency rescue transfer system according to claim 1, wherein the attracting device is an electromagnet.

3. The marine emergency rescue transfer system according to claim 1, wherein the automatic lifting device comprises a platform, a telescopic unit, a rotating unit, a lifting unit, a winch, a sling, and a lowering motor;

wherein the lifting unit is installed on the water navigation robot; the rotating unit is installed on a lifting end of the lifting unit; the telescopic unit is installed on a rotating end of the rotating unit; the platform is installed on a telescopic end of the telescopic unit; the fixing sealing device is installed on the platform;

wherein the winch is installed on the water navigation robot; the platform is connected with the winch through the sling; the winch is connected with an output shaft of the lowering motor;

wherein the telescopic unit, the rotating unit, the lifting unit, and the lowering motor are respectively electrically connected with the rescue terminal.

4. The marine emergency rescue transfer system according to claim 3, wherein the water navigation robot comprises a U-shaped end; the winch is installed on an inner side of the U-shaped end; the platform is arranged in the U-shaped end.

5. The marine emergency rescue transfer system according to claim 4, wherein a U-shaped sliding rail is installed on the U-shaped end of the water navigation robot; a counterweight block is installed on the U-shaped sliding rail; electric control pulleys are installed on positions of the counterweight block where the counterweight block are connected with the U-shaped sliding rail; the counterweight block is slidably connected with the U-shaped sliding rail through the electric control pulleys;

wherein the electric control pulleys are electrically connected with the rescue terminal.

6. The marine emergency rescue transfer system according to claim 1, wherein the fixing sealing device further comprises a drainage device; the drainage device comprises a drainage pump, a drainage pipe, a water pumping pipe, and at least one drainage valve;

wherein the box body defines a drainage hole; the water pumping pipe is arranged in the box body and is communicated with the drainage hole through the drainage pump; the drainage pipe is arranged on the outer side of the box body and is communicated with the drainage hole; the at least one drainage valve is installed on the drainage pipe and/or the water pumping pipe;

wherein the drainage pump and the at least one drainage valve are respectively electrically connected with the rescue terminal.

7. The marine emergency rescue transfer system according to claim 1, wherein the rescue devices comprise a drilling device, an electric welding device, a sealing steel plate, and a transfer pipe;

wherein the remote control grippers are configured to grip the drilling device, and the drilling device is configured to drill a hole on the accident ship; the hole is configured as a transfer hole;

wherein the remote control grippers are configured to grip the transfer pipe and are configured to extend the transfer pipe into the transfer hole, so the accident ship is connected with the water navigation robot; the remote control grippers are configured to retract the transfer pipe after the transfer operation is completed;

wherein the remote control grippers are configured to grip the sealing steel plate and are configured to insert the sealing steel plate into the transfer hole;

wherein the remote control grippers are configured to grip the electric welding device; the electric welding device is configured to weld the sealing steel plate on the transfer hole to seal the transfer hole.

8. The marine emergency rescue transfer system according to claim 7, wherein the drilling device is a water cutting drilling machine; the water cutting drilling machine comprises a high-pressure water generating device, a pumping pipe, a water drilling gun, a high-pressure pumping pipe, and a camera;

wherein a water inlet end of the high-pressure water generating device is communicated with the pumping pipe; a water outlet end of the high-pressure water generating device is communicated with the water drilling gun through the high-pressure pumping pipe; the camera is installed on the water drilling gun; the camera is arranged a head of the water drilling gun;

wherein the camera and the water drilling gun are respectively electrically connected with the rescue terminal.

9. The marine emergency rescue transfer system according to claim 1, wherein the marine emergency rescue transfer system further comprises a cooling device; the cooling device is configured to cool the accident ship;

wherein the cooling device comprises an onboard water pump, a compressed water tank, a water pipe, and a spray head; the onboard water pump is communicated with the compressed water tank; the compressed water tank is communicated with the spray head through the water pipe; the onboard water pump is configured to pump seawater for compression; and the spray head is configured to spray water mist to cool the accident ship;

wherein the onboard water pump is electrically connected with the rescue terminal.

10. The marine emergency rescue transfer system according to claim 1, wherein a plurality of monitoring cameras are installed on the water navigation robot, and the plurality of monitoring cameras are electrically connected with the rescue terminal.

* * * * *